175-48
4/7/87 XR 4,655,299

United States Patent [19]

Schoeffler

[11] Patent Number: 4,655,299

[45] Date of Patent: Apr. 7, 1987

[54] ANGLE DEVIATION TOOL

[75] Inventor: William N. Schoeffler, Lafayette, La.

[73] Assignee: Petro-Design, Inc., Youngsville, La.

[21] Appl. No.: 784,261

[22] Filed: Oct. 4, 1985

[51] Int. Cl.[4] ..... E21B 7/08

[52] U.S. Cl. ..... 175/38; 175/48; 175/61

[58] Field of Search ..... 175/24, 38, 61, 74, 175/256, 269, 48; 166/53

[56] References Cited

U.S. PATENT DOCUMENTS 2,345,766 4/1944 Miller ..... 175/269
2,375,313 5/1945 Miller ..... 175/256

FOREIGN PATENT DOCUMENTS 0750036 7/1980 U.S.S.R. ..... 175/61
0969881 10/1982 U.S.S.R. ..... 175/74

*Primary Examiner*—James A. Leppink
*Assistant Examiner*—Terry Lee Melius
*Attorney, Agent, or Firm*—John D. Jeter

[57] ABSTRACT

A normally straight drill string component for use just above a downhole drilling motor, or directional jet, that can be caused to be alternately straight or bent by cycling the drilling fluid flow rate between selected flow rate limits by use of controls at the earth surface.

10 Claims, 4 Drawing Figures

ANGLE DEVIATION TOOL

Apparatus of this invention incorporates, as a subassembly, apparatus of my co-pending application Ser. No. 784,262 filed Oct. 4, 1985. By reference, that application is made part of this specification.

FIELD OF UTILIZATION

This invention pertains to earth borehole operations involving drill strings through which drilling fluid is pumped downhole by pumps at the earth surface. More particularly, apparatus of this invention will be used with downhole drilling motors, or directional jets, and will, at least occasionally, be exercised, by signals sent downhole from the earth surface, to influence the course of the borehole being drilled.

BACKGROUND

In the drilling of earth boreholes, the term "straight hole drilling" commonly means no active effort is being made to change the course of a progressing bore, whatever the existing angle or direction of the hole may be. Directional drilling efforts are generally construed to mean efforts are being made by active devices downhole to change the existing course of a progressing well bore.

There are many devices commonly used downhole to change the course of a bore, usually defined as the angle off vertical and the direction relative to an azimuthal earth reference, usually north. Currently, the most effective means to change course of a bore is to use a bent drill string component just above a fluid powered downhole drilling motor. The bent component is referred to as a bent sub. In softer formations being drilled, a jet on one side of a drill bit can be used to cause a progressing hole to change course. The jet has to be oriented relative to an azimuthal earth reference, if the direction favored is to be controlled. A bent sub, if used with the jet system, allows the drill string to follow through the curve in the borehole the jet tends to produce.

Drilling with a bent sub commonly requires only a few hours to achieve the course control purpose. The drill string is then commonly removed from the hole to remove the bent sub, and the drill string is again assembled with or without the downhole motor or jet, so that straight hole drilling may continue. This is called "tripping the string" and may take more than ten hours.

It is highly desirable to avoid tripping the drill string, and to that end, several efforts have been made over several years. The best known method accomplishing the effect of changing from a bent sub to a straight sub without tripping the drill string involved a form of gimbal, or hinge, in the drill string that was controllable. Control of the gimbal was exercised by dropping a spear down the drill string bore to hold the gimbal straight and recovering the spear by a wire line to permit the controlled device to effectively bend. The bend, or deflection, of the drill string rarely exceeded three degrees. The exercise of the spear controlled device consumed considerable time because of the trips down the pipe bore with the wire line.

The need to conveniently change, by simple actions of the earth surface, the configuration of downhole equipment to permit alternate straight hole and directional drilling, has persisted for years. More frequent conversion to directional drilling configuration reduces the required angle of pipe string centerline deflection to something like one degree. This permits construction of more rugged gimbals, which are prone to weakness. Additionally, frequent smaller corrections of well bore direction produces a better hole, more easily cased and serviced.

Apparatus of this invention, utilizing the Control Selector Valve of my copending application Ser. No. 784,262, has recently been used in downhole well drilling operations.

OBJECTS

It is therefore an object of this invention to provide apparatus to alternately change the downhole machinery between the options of straight hole and directional drilling configuration by the expedient of cycling the flow rate of drilling fluid between higher and lower rates by surface controls.

It is another object of this invention to provide apparatus with at least two possible states of downhole conditions with a drilling fluid flow rate resistance detectable at the earth surface, that is peculiar to each state.

It is yet another object of this invention to provide apparatus that permits convenient change of angle permitted when the downhole apparatus is in the directional drilling state by change of simple elements during assembly of downhole apparatus.

It is still another object of this invention to provide apparatus for use downhole on pipe strings in earth boreholes that will cause an angle change in the pipe string axis by action initiated at the earth surface by manipulation of standard drilling fluid flow controls.

These and other objects, advantages, and features of this invention will be apparent to those skilled in the art from a consideration of this specification, including the attached drawings and appended claims.

BRIEF DESCRIPTION OF DRAWINGS

In the drawings, wherein like reference characters are used throughout to designate like parts.

DETAILED DESCRIPTION OF DRAWINGS

Figure 1:
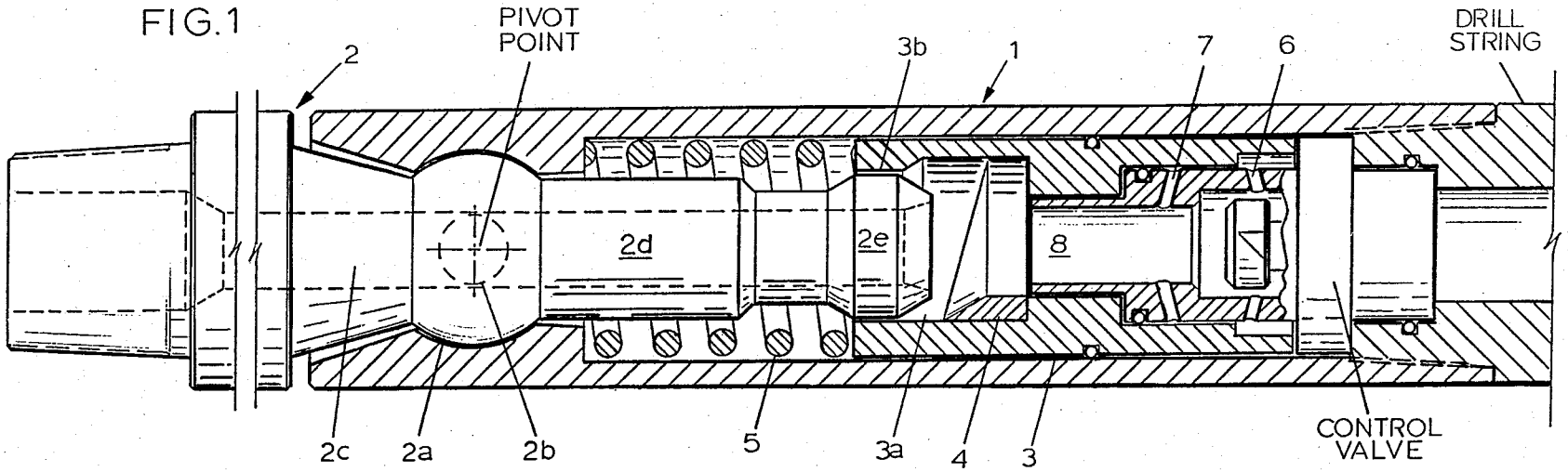
FIG. 1 is a plan view in partial cutaway of the preferred embodiment of the apparatus of this invention.

FIG. 1 is the preferred embodiment of the apparatus of this invention. The right hand end commonly attaches by tool joint threads to an upwardly continuing drill string. The left hand end, also the lower end in use and the downstream end relative to fluid flow, is commonly attached by tool joint threads to a downhole drilling motor, or a directional jet assembly. Drilling fluid flows down the drill string bore, into and through this apparatus, continues through the drilling motor, is expelled through a drilling bit, and returns to the earth surface outside the drill string, inside a well bore. If a directional jet is used, the motor is omitted.

In essence, this device, when directed to do so, changes the direction of the drill string axis at the pivot point. When further directed to return to the normal configuration shown, the drill string axis is again made straight by pivoting at the pivot point. This is called "bending the drill string," although no permanent deformation of metal takes place.

Various threaded connections that are of assembly utility but not functional in terms of actions defining points of novelty are omitted for descriptive convenience.

The drill string shown joins housing 1 with a special connection which confines the control valve in the housing. By processes yet to be described, the control valve responds to cycling the rate of fluid flow down the bore of the drill string to alternately open and close a valve admitting fluid through the valve to duct 8.

Cycling of fluid flow rate will be construed to define the act of changing fluid flow rate from one flow rate to another, then changing the rate back toward the original rate, not necessarily back to the original flow rate.

In the preferred embodiment of this invention, drilling can take place only with a substantial drilling fluid flow rate relative to the drilling system capability. In common use, it is expected that the downhole state (straight hole or directional configuration) that exists when fluid flow is stopped for connections, will be switched to the opposite state when drilling fluid flow is resumed. This may not be desirable, and a short cycle will be executed by increasing the flow to about twenty-five percent of operational flow to arm, or enable the downhole system to reverse state on the next immediate cycle. The flow will be reduced to near zero flow and again increased to operational level, and drilling, with the downhole apparatus now switched to the original state, will proceed, It will probably be desirable to use one flow rate for straight hole drilling, reduce flow to change state downhole, and increase flow to a yet different level for directional drilling.

The selector valve of my copending application can be set up by small change in internal parameters to respond to various flow rate relationships when the flow rate is cycled to first arm, or enable, then to actuate a change of state. This is anticipated by and is within the scope of the claims.

Port 6 is always in communication with the bore of the drill string. When the control valve is open, fluid flows through duct 8 and bore **2*c* with a reasonably low pressure change. When the control valve is closed, fluid entering from the drill string bore must exit through ports 6. Thus fluid will act on the right end of piston assembly 3, forcing it to move leftward, overcoming the bias of spring 5 and uncovering ports 7, which are in communication with duct 8 below the control valve. The fluid then flows leftward through the bore 2*c***.

When the piston assembly moves leftward, receiving bore **3*a* moves over the boss 2*e* on bar 2*d* of arbor 2. Insert 4 has an eccentric bore and forces boss 2*e* upward into the eccentric bore. Arbor 2 pivots about the centerline of torque pin 2*b***. This changes the axis of the arbor, and the leftwardly extending arbor centerline differs from the extended centerline of the upwardly continuing drill string. The angle can be expected in use to approximate two degrees.

The primary function of the spherical gimbal **2*a* is to transmit axial thrust, to generally contribute strength to the flexing system, and to facilitate fluid sealing. Pin 2*b*** is perpendicular to the plane of the drawing, which defines the plane containing the two centerlines which are coincident in one state of configuration and non-parallel in a second state of configuration.

Insert 4 comprises a means to adjust the angle the arbor 2 makes with the housing 1, when the general configuration is defined as bent for directional drilling. The eccentric bore of insert 4 must always accept and constrain the boss **2*e***, but the amount of eccentricity can be any small amount up to the maximum eccentricity geometry permits.

When the drilling fluid flow rate is cycled by surface fluid controls to low flow (or no flow), and a higher flow rate is restored, the control valve re-opens by processes yet to be described. Fluid can then flow directly from the drill string, through the valve and duct 8, and on through the system with reduced resistance. There is no pressure differential available to urge the piston assembly leftward, and the spring moves the piston assembly to the right, and centering bore **3*b* again is restored to the position shown. Boss 2*e*** is centered and constrained, and the general longitudinal axis of the system is straight for straight hole drilling.

Figure 2:
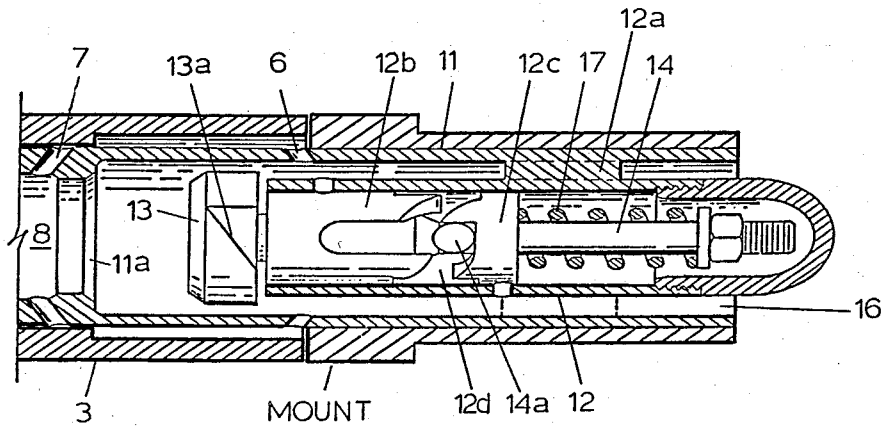
FIG. 2 is a plan view in partial cutaway of a sub assembly shown in block form in FIG. 1.

In FIG. 2, the control valve of FIG. 1 is shown in a mount for centering in a sealed and supported situation in housing 1, such that fluid flowing down the drill string will be compelled to flow through channel 16. The action to be carried out as a result of selective actuation of the control valve is forceful movement of the piston 3. Sealing and confining structure for the piston is omitted to emphacise the points of novelty.

Body 11 is secured in the pipe string bore (not shown) with orifice **11*a* at the downstream end. Enclosure 12 is secured in the body generally concentric with the axis of channel 16, secured by spiders 12*a*, and also has a cylindrical co-axial bore. Cams 12*b* and 12*c* are secured by pins in the enclosure bore as shown, so contoured and spaced apart as to cooperate to form serpentine groove 12*d*. The cams have a concentric bore to serve as support bearings for valve control rod 14**.

Control rod 14 extends into and is fastened to poppet 13. Crosshead pin **14*a* is transverse, extends equally from both sides of, but is part of control rod 14. Pin 14*a* is confined within groove 12*d*. For reasons explained later, pin 14*a* will be free to move peripherally around the confines of the groove, and in this case, there will be four possible locations for one pin, permitting at least some axial excursions of the pin in the groove. These four positions are about ninety degrees apart. As will be shown, the groove at alternate possible axial movement locations will extend far enough axially for poppet 13 to move into cooperation with orifice 11*a***, to inhibit fluid flow through the orifice. The other cam locations permitting axial excursions of the pin stop before allowing the poppet to reach the orifice.

Spring 17 exerts a force between the enclosure and control rod and tends to move the rod and poppet to the right or upstream. Fluid moving left through channel 16 tends to entrain the poppet and move it left. This pulls rod 14 to the left. A surface **13*a* is milled into the poppet periphery and has a turbine surface exposed to the fluid stream. Viewed from the left, this tends to rotate poppet 13, rod 14, and pin 14*a*** clockwise and move all toward the orifice.

Starting with no fluid flow, the poppet and pin **14*a* will be positioned as shown. As fluid flow moving left in channel 16 increases, the poppet will overcome spring bias and move left, and rotate clockwise as described, moving pin 14*a* along the helical path of groove 12*d*. The helical portion of the groove terminates at an axial groove, and as flow increases, the pin will move as far axially as the groove permits. On alternate axial excursions, the poppet is allowed to proceed into cooperation with the orifice, which may or may not be a closure, but will cause increased flow resistance. Fluid will be encouraged to flow through the alternate channel 6**, and is the effect to be accomplished by the control valve.

When fluid flow is sufficiently reduced, spring 17 will begin retraction of rod 14 into the enclosure, and pin 14*a* will move to the right along the axial travel permitted by groove 12*d*. The poppet will still be urged clockwise, as described, and the pin will not re-enter the first helical path intersection, and will proceed to the upper limit of travel. With spring force still urging the rod to the right, the pin will not be able to enter the second helical path encountered by the pin. Restart of fluid flow will repeat the process described above, but the next axial excursion permitted by groove 12*d* and pin 14*a* will stop the poppet before it reaches the previous permitted travel limit.

The effect of the action so far described will be to resist the flow of fluid through the orifice. Available alternate paths for fluid flow include duct 6. This will make the available fluid pressure act on and move piston 3 with results already described.

Ducts 6 and 7 are so sized that fluid flow through them will have a greater resistance than the existing in the open orifice. The resulting pressure increase will be an uplink acquisition signal detectable at the surface to indicate which state (straight or bent axis) exists downhole.

It should be noted that all of the bottom hole drilling assembly is commonly considered part of an assembled drill string. From any connection, it should be realized that a downwardly continuing drill string may include any number of components but may in some cases include only a drill bit or any other drill string lower terminal element.

Figure 3:
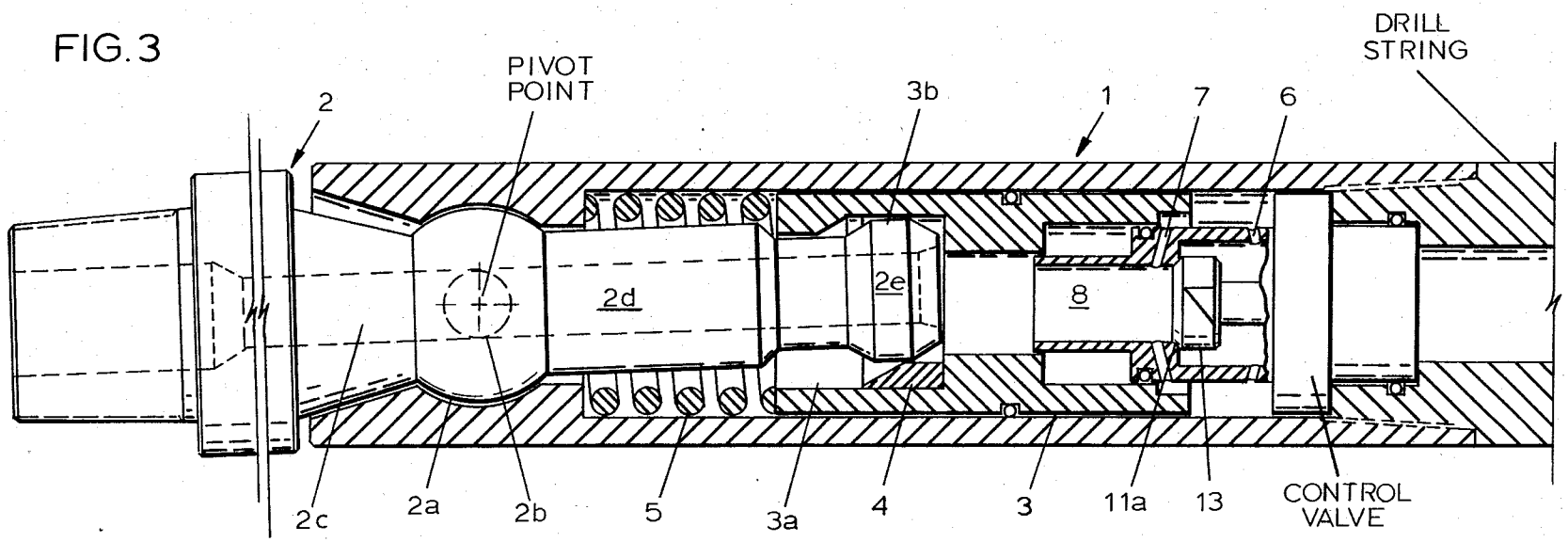
FIG. 3 is a plan view in partial cutaway of the apparatus of FIG. 1 in the actuated or "bent" configuration.

FIG. 3 is identical to FIG. 1, showing the elements that move to cause deflection of the left centerline or the bent configuration. The control valve of FIG. 4 has dropped poppet 13 onto seat 11*a* and inhibited fluid flow through duct 8, and fluid moving leftward has been forced through ports 6, acted on piston assembly 3 to move it left until the piston uncovered ports 7, allowing fluid to re-enter duct 8 and continue through the tool bore 2*c*.

Insert 4 has forced boss 2*e* upward into the eccentric bore deflecting the lower, or left, centerline to bend about the pivot point. The arbor 2 will be retained in this deflected, or bent, second state of configuration as long as fluid flow down the drill string bore continues.

Figure 4:
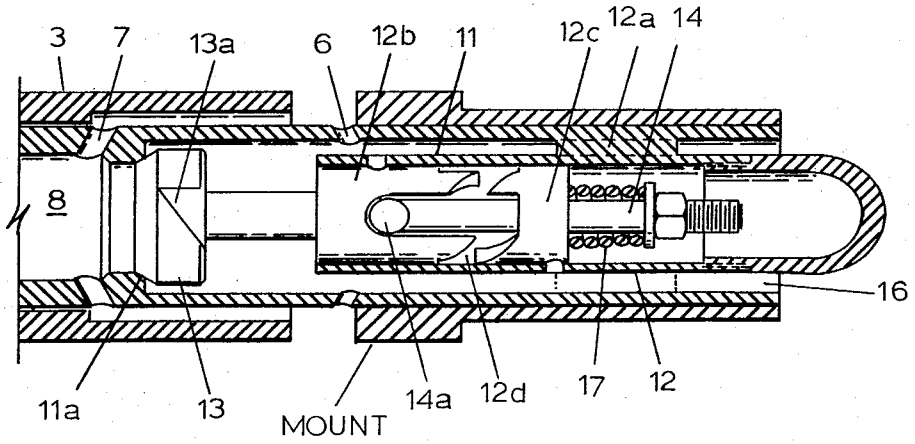
FIG. 4 is a plan view in partial cutaway of the subassembly of FIG. 2, in the position to actuate the deflecting tool.

FIG. 4 is identical to FIG. 2 but shown actuated by fluid flow to cause deflection of the tool. The condition of FIG. 4 should be regarded as preceding the condition shown in FIG. 2, because pin 14*a* is still in the long segment of serpentine groove 12*d*. In FIG. 4, poppet 13 has been entrained by flow moving leftward and is in contact with seat 11*a* to inhibit flow directly to duct 8. Flow is forced through ports 6 to act on piston 3 to force piston 3 leftward until ports 7 are uncovered, allowing flow to re-enter duct 8 with the consequence already described herein.

The invention having been described, what is claimed is:

1. A drilling assembly usable downhole on fluid conducting drill strings, situated in earth boreholes for selecting straight hole or directional drilling configuration of the downhole assembly by manipulation, at the earth surface, of drilling fluid flow controls, apparatus comprising:

(a) a body with an upper end with connector means to attach to the upwardly continuing drill string, and a lower end with means to attach to the downwardly continuing drill string, and at least one fluid conducting channel to conduct fluid between said portions of the continuing drill string, each end of said body having an independent longitudinal centerline;

(b) control selector means within said body in communication with said channel responsive to a first preselected number of increases, greater than a preselected amount, of the fluid flow rate through said channel to produce a first output signal, and responsive to a second preselected number of increases, greater than a preselected amount, of the fluid flow rate through said channel to produce a second output signal;

(c) means at the earth surface to cycle said drilling fluid flow rate between higher and lower flow rates; and (d) hinge means in said body responsive to said first output signal to cause said centerlines to generally coincide, and responsive to said second output signal to cause said centerlines to produce an effectively bent overall body centerline.

2. The apparatus of claim 1 further providing that said body centerlines at each end be approximately coincident with the centerlines of the continuing drillstring thereto attached.

3. The apparatus of claim 1 further providing that said fluid flow rate cycling comprise the cessation of fluid flow and the resumption of fluid flow.

4. The apparatus of claim 1 further providing that said flow cycling comprise the reduction of fluid flow rate and the subsequent increase of fluid flow rate.

5. The apparatus of claim 1 further providing, for said selector means, a selector valve comprising an actuator responsive to the cycling of fluid flow rate from a first rate to a second rate and back toward said first rate, to re-route said fluid flow between a first channel and a second channel, alternately, said re-routed flow comprising said first and said second output signals.

6. The apparatus of claim 5 further providing that each of said channels present a resistance to fluid flow that differs from fluid flow resistance in other channels.

7. The apparatus of claim 1 further providing that said hinge means be made responsive to said signal by means comprising a fluid pressure-to-force converter so linked to said hinge means as to cause said centerline to be generally straight in response to said first output signal, and will cause said centerlines to be relatively bent in response to said second output signal.

8. The apparatus of claim 7 further providing that said hinge means comprise at least one hinge pin, with a pin axis extending approximately perpendicularly from a plane containing both said upper and lower body centerlines, when said body is relatively bent.

9. The apparatus of claim 7 further providing that said hinge means comprise a sphere and socket to permit effective bending of said centerline.

10. The apparatus of claim 9 further providing that at least one hinge pin extend radially from said spherical surface with an extended axis originating at said sphere center and extend radially perpendicular to a plane containing both body centerlines, when said body is bent.

* * * * *